US010529200B2

(12) United States Patent
Toulemonde et al.

(10) Patent No.: US 10,529,200 B2
(45) Date of Patent: Jan. 7, 2020

(54) ALARM SENSOR AND SYSTEM COMPRISING SUCH A SENSOR

(71) Applicant: KEEPEN, Paris (FR)

(72) Inventors: Louis Toulemonde, Paris (FR); Guillaume Reinhardt, Lewarde (FR)

(73) Assignee: KEEPEN, Paris (FR)

( * ) Notice: Subject to any disclaimer, the term of this patent is extended or adjusted under 35 U.S.C. 154(b) by 0 days.

(21) Appl. No.: 16/311,456

(22) PCT Filed: Jun. 20, 2017

(86) PCT No.: PCT/FR2017/051639
§ 371 (c)(1),
(2) Date: Dec. 19, 2018

(87) PCT Pub. No.: WO2017/220926
PCT Pub. Date: Dec. 28, 2017

(65) Prior Publication Data

US 2019/0236918 A1 Aug. 1, 2019

(30) Foreign Application Priority Data

Jun. 21, 2016 (FR) ..... 16 55756

(51) Int. Cl.

| | |
|---|---|
| ***G08B 13/00*** | (2006.01) |
| ***G08B 13/08*** | (2006.01) |
| ***G08B 25/00*** | (2006.01) |
| ***G08B 25/10*** | (2006.01) |

(52) U.S. Cl.
CPC ..... *G08B 13/08* (2013.01); *G08B 25/008* (2013.01); *G08B 25/10* (2013.01)

(58) Field of Classification Search
CPC ..... G08B 13/08; G08B 25/008; G08B 25/14; G08B 21/0236; G08B 21/0238; G08B 1/08; G08B 21/00
USPC ..... 340/545.1, 545.2, 545.3, 565
See application file for complete search history.

(56) References Cited

U.S. PATENT DOCUMENTS

| | | | |
|---|---|---|---|
| 2008/0157964 A1 | 7/2008 | Eskildsen et al. | |
| 2019/0096202 A1* | 3/2019 | Seelman | G08B 25/008 |

FOREIGN PATENT DOCUMENTS

| | | |
|---|---|---|
| AL | 102013103535 A1 | 10/2014 |
| DE | 3701136 A1 | 10/1988 |
| GB | 2095016 A | 9/1982 |

OTHER PUBLICATIONS

International Search Report related to Application No. PCT/FR2017/051639; dated Oct. 10, 2017.
French Search Report Application No. FR 16 55756; dated Feb. 15, 2017.

* cited by examiner

*Primary Examiner* — Toan N Pham
(74) *Attorney, Agent, or Firm* — Miller, Matthias & Hull LLP

(57) ABSTRACT

An alarm sensor for an opening of a building area comprising an opening sensor suited for detecting an opening event of the opening, an inhibition device suited for at least determining the presence of a person in the interior space near the opening, and an electronic unit suited for providing the detection signal if the opening sensor detected the opening event and if the inhibition device did not detect a presence during a first time before the opening event.

21 Claims, 6 Drawing Sheets

ALARM SENSOR AND SYSTEM COMPRISING SUCH A SENSOR

CROSS-REFERENCE TO RELATED APPLICATION

This Application is a 35 USC § 371 US National Stage filing of International Application No. PCT/FR2017/051639 filed on Jun. 20, 2017, and claims priority under the Paris Convention to French Patent Application No. 16 55756 filed on Jun. 21, 2016.

FIELD OF THE DISCLOSURE

Technical Field

The present invention relates to alarm sensors, alarm systems and uses thereof.

BACKGROUND OF THE DISCLOSURE

Autonomous alarm systems are known which are composed of a single object to be attached to the element to be protected. These autonomous alarms usually comprise an opening sensor or volumetric sensor and a siren.

Centralized alarm systems are known which comprise a central unit and a plurality of sensors of various types, connected to said central unit by a wired or wireless connection.

These autonomous or centralized alarm systems must be manually activated by the user each time they leave the area, where the area is then assumed to be empty. They must be manually deactivated by the user each time that the user enters the area, to avoid any alert. If the user forgets to activate the alarm system when leaving the area, the area is not protected. There is also a partial activation mode with a user authorized to move in a part of the area.

If the user forgets to deactivate the alarm system on entering the area, a false alert could be generated.

This is why centralized alarm systems are usually connected to a remote monitoring manager who calls the user first and who has a security agent respond only after this verification. Unfortunately, this method is costly and slows the response in case of an actual intrusion.

BRIEF SUMMARY OF THE DISCLOSURE

The goal of the present invention is to propose an alarm sensor for an opening and an alarm system comprising such a sensor which avoids the disadvantages listed above.

The opening is for example a door or window. This opening comprises a fixed part surrounding an opening and a mobile part suited for opening or closing said opening, where said opening is located between an interior space and an exterior space of the area.

For this purpose, the alarm sensor for an opening of a building area according to the invention is suited to provide a detection signal and comprises:

- an opening sensor suited for detecting an opening event of the opening;
- an inhibition device suited for at least determining the presence of a person in the interior space near the opening;
- a cancellation device suited for being activated by the identification of a person; and
- an electronic unit suited for providing the detection signal:

1) if the opening sensor detected the opening event; and 2) if the inhibition device did not detect a presence during a first time before the opening event; and 3) if the cancellation device was not activated during a second time after the opening event.

Because of the combination of an opening sensor and an inhibition device, the alarm sensor distinguishes between openings of the opening coming from the outside, which are very pertinent for detecting an intrusion, and those coming from the inside, which are to be eliminated. Thus, the false detection rate is sharply reduced.

The alarm system can then send the alert directly to the relevant security agent, which reduces the response time. The cost for the remote monitoring manager can then be greatly reduced. Further, the alarm system can send the same alert simultaneously to the user for additional verification.

Additionally, the user of an alarm system using this sensor does not need to deactivate the alarm when they are present; identifying themselves when they return is all that's needed so that the alarm system can remain active continuously. Because of this operation, the user can no longer forget to activate the alarm system when leaving the area and there is no risk of leaving this area unprotected.

Further, overall using this operation is overall simpler.

Finally, if the user uses a wireless electronic device (e.g. a wireless badge) paired with the cancellation device, the user no longer has any action to take when entering and leaving.

In various embodiments of the alarm sensor according to the invention one and/or another of the following dispositions can also be used.

According to an aspect, the opening sensor comprises two elements: a first element is connected to the fixed part of the opening, and a second element is connected to the mobile part of the opening, where said opening sensor is suited for detecting an opening event when the second element moves away from the first element.

According to an aspect, the opening sensor detects the opening event by magnetic effect or by optical effect or by movement.

According to an aspect, the inhibition device is a device comprising:

- a button suited for being pressed by a person;
- a volumetric sensor which detects the movement of a person;
- a volumetric sensor which detects the movement of a person who approaches said inhibition device;
- a camera which captures successive time images and which detects movement in said images; or
- a proximity sensor.

According to an aspect, the inhibition device is a volumetric sensor which detects the movement of a person and which detects whether said person is going away from said inhibition device, and in which the electronic unit provides the detection signal only if the presence detected by the inhibition device corresponds to a movement of said person away from said inhibition device.

According to an aspect, the cancellation device comprises:

- a badge reader;
- a wireless reader;
- a keypad; or
- a biometric reader.

According to an aspect, the cancellation device is a wireless reader suited for being wirelessly connected to a wireless electronic device.

According to an aspect, said wireless electronic device has an average wireless emission which has a range which is a maximum detection distance, and the cancellation device sends the wireless electronic device an adjustment value for said range of the wireless electronic device.

According to an aspect, the cancellation device can be activated if it detects the presence of the wireless electronic device.

According to an aspect, the wireless reader estimates a distance between said wireless reader and the mobile wireless electronic device.

According to an aspect, the cancellation device (24) can be activated only if the distance is shorter than a cancellation distance.

According to an aspect, the cancellation distance is less than 5 m.

According to an aspect, the cancellation distance is less than 2 m.

According to an aspect, the cancellation distance depends on an identifier from the mobile electronic device.

According to an aspect, the cancellation distance is determined depending on previously detected resting distances, where a resting distance is the distance between the wireless reader and the mobile electronic device which is stored for a time greater than a third time and where the cancellation distance is then shorter than any resting distance.

According to an aspect, the cancellation device performs a method of monitoring wireless electronic devices, during which:

if the wireless electronic device is detected during a time greater than a fourth time, the wireless electronic device is deactivated, and if the wireless electronic device is no longer detected, the wireless electronic device is activated.

According to an aspect, the cancellation device performs a method of monitoring wireless electronic devices by wireless electronic device presence analysis, repetitively with a period of analysis, and during each analysis:

if the wireless electronic device is detected, a counter is incremented;

if the counter is over a threshold value, the electronic device is deactivated, which means that it can no longer activate the cancellation device;

if the wireless electronic device is not detected, the counter is reset to an initial value and the wireless electronic device is activated which means that it can activate the cancellation device.

According to an aspect, after the detection of the opening event, the analysis period is adjusted to a first value, then after a predetermined number of analyses, the analysis period is adjusted to a second value longer than the first value.

According to an aspect, the inhibition device is a volumetric sensor which detects the movement of the person and which detects whether said person is going away from said inhibition device, and in which the electronic unit provides the detection signal only if the presence detected by the inhibition device corresponds to a movement of said person away from said inhibition device.

According to an aspect, the inhibition device is a volumetric sensor positioned such that a first plane is a plane substantially perpendicular to the opening and substantially perpendicular to the floor of the area, where said first plane is the plane of highest density of alternating activity and inactivity for the detection of movement.

According to an aspect, the volumetric sensor has a first opening angle less than 45° in said first plane.

According to an aspect, the inhibition device is a volumetric sensor which is directed towards the inside handle of the opening or a point located near said handle.

According to an aspect, the inhibition device is a volumetric sensor which comprises two detection elements and a wall located between said detection elements.

According to an aspect, the volumetric sensor does not comprise an optical system for focusing on said detection elements.

According to an aspect, the alarm sensor is suited for being attached onto the opening.

According to an aspect, the alarm sensor comprises at least one part suited for being attached onto the mobile part of the opening.

According to an aspect, the opening is either a door or window.

According to an aspect, the electronic unit comprises a transmission member suited for sending the detection signal either by a wired connection or by a wireless connection.

The invention also relates to an alarm system for a building area comprising:

an alarm sensor of the aforementioned type, and an alarm central unit suited for receiving the detection signal coming from the alarm sensor and comprises an alert device suited for generating an alert if a detection signal is received.

In various embodiments of the alarm system according to the invention one and/or another of the following dispositions can also be used.

According to an aspect, the alert device is:

a siren which generates a sound and/or a light signal; or a communication member suited for sending the alert to a remote device.

According to an aspect, the communication member sends the alert:

by an ethernet, ADSL, fiber-optic or cable type wired connection; or by Wi-Fi, GSM, or Internet of things type wireless connection.

According to an aspect, the alarm system further comprises:

a central unit cancellation device suited for being activated by the identification of a person, and which cancels the alert if the central unit cancellation device was activated during a second time after the opening event.

According to an aspect, the central unit cancellation device is:

a badge reader;

a keypad; or a biometric reader.

According to an aspect, the alarm sensor and the alarm central unit are combined in a single case.

The invention also relates to a method for use of an alarm system of the type cited above, comprising, following the generation of an alert by the alarm system, the following steps:

a) the alarm system located in the area sends the alert to a security agent located in a region that covers said alarm system; and b) the security agent receives the alert sent in step a) and responds to the area of said alarm system.

In various embodiments of the method for use of the alarm system according to the invention one and/or another of the following dispositions can also be used.

According to an aspect, the method comprises the following additional step:

c) the alarm system located in the area sends the alert to an authorized person.

According to an aspect, the authorized person has a means suited for communicating with the security agent and for canceling the alert sent in step a).

BRIEF DESCRIPTION OF THE DRAWINGS

Other features and advantages of the invention will become apparent during the following description of six of the embodiments thereof, given as a nonlimiting example, with reference to the attached drawings.

In the drawings.

In the various figures, the same numerical references designate identical or similar items.

DETAILED DESCRIPTION OF THE DISCLOSURE

Figure 1:
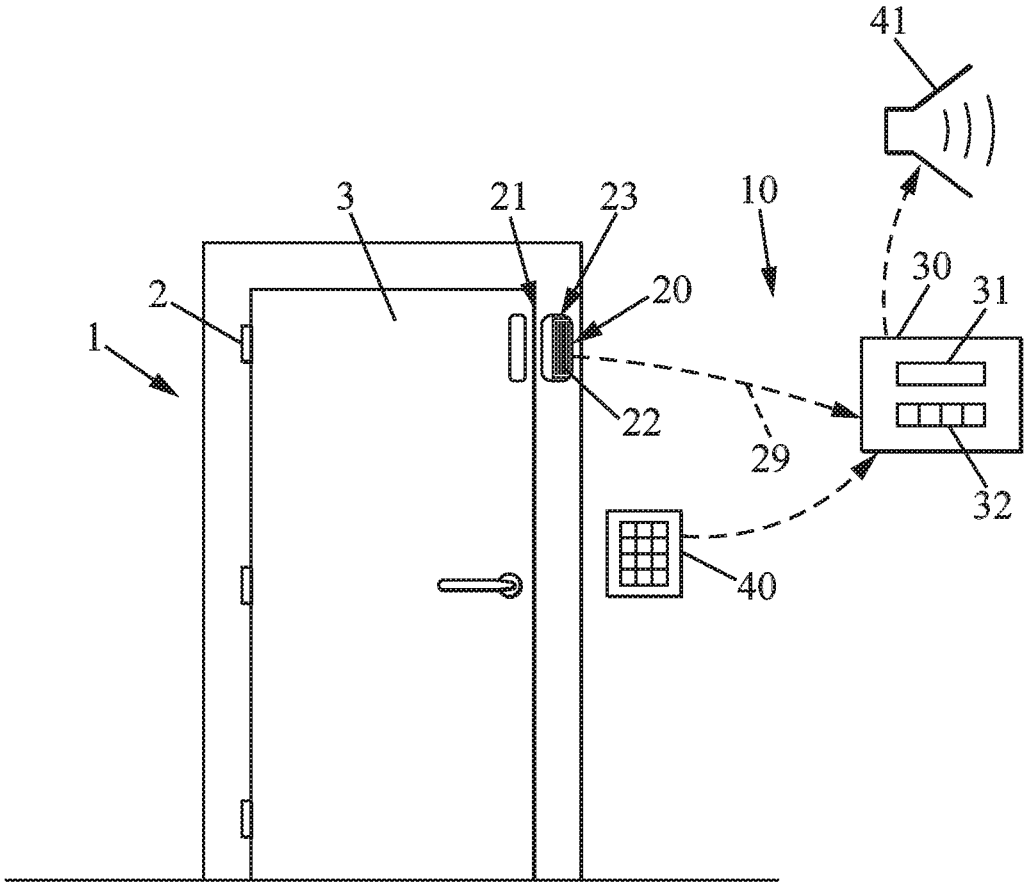
FIG. 1 is an overall schematic view of a first embodiment of an alarm system according to the invention installed on an opening.

FIG. 1 is an overall view of the system for a first embodiment of the alarm system 10 according to the invention.

This alarm system 10 comprises, for example:

- an alarm sensor 20 for an opening according to the invention;
- a central unit 30 including for example in a case: a display 31, and a central unit keypad 32; and
- possibly, a remote keypad 40, advantageously placed near an entry door, corresponding to an opening 1 of a building area, and/or an external siren 41, where both are connected to the case for the central unit 30 by a wired or wireless connection for greater ease and security.

The opening 1 shown in FIG. 1 is a door, but the opening could be a window. The opening 1 has a fixed part 2 surrounding an opening and a mobile part 3 suited for closing or opening said opening. This opening 1 (opening) is located between a space inside the area and a space outside it. With the present alarm system, protection for the area is therefore sought against any undesired intrusion from the outside.

Figure 2:
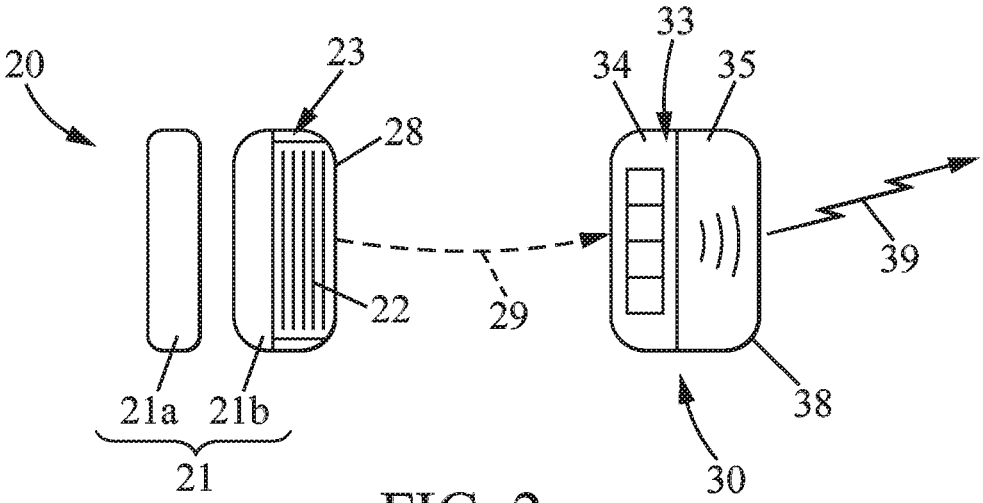
FIG. 2 is a schematic view of a first embodiment of the alarm system from FIG. 1.

FIG. 2 shows more precisely the alarm system 10 comprising the alarm sensor 20 for an opening and the central alarm unit 30 according to a first embodiment of the invention.

The alarm sensor 20 comprises:

- an opening sensor 21 which detects an opening event of the opening 1;
- an inhibition device 22 which detects the presence of a person in the interior space near the opening 1; and
- an electronic unit 23 connected to the opening sensor 21 and the inhibition device 22 and which generates a detection signal.

The opening sensor 21 is suited for detecting an opening event of the opening 1, meaning the opening of the mobile part 3. This opening event can be determined by the movement of the mobile part 3 relative to the fixed part 2 or by the movement of the mobile part 3 alone.

According to a first variant, the opening sensor 21 can comprise a single element connected to the mobile part 3 for measuring movement thereof, meaning displacement, velocity or acceleration thereof. An accelerometer or a gyroscopic sensor can be used to detect this movement.

According to a second variant, the opening sensor 21 may comprise two elements 21*a*, 21*b*. The first element 21*a* is connected to the mobile part 3 and the second element 21*b* is connected to the fixed part 2, as shown in FIGS. 1 and 2, or inversely.

The opening sensor 21 of this second variant is for example a magnetic sensor. The magnet is housed in the first element 21*a* and a "Reed" sensor or "Hall effect" sensor type sensor is housed in the second element 21*b*. Such a "Reed" sensor is well known and has flexible blades of magnetic material which magnetize by influence, and which are drawn together in the presence of a magnetic field generated by the magnet. This sensor therefore closes an electric circuit when the first and second elements 21*a*, 21*b* are close to each other.

The opening sensor 21 of this second variant is possibly an optical sensor, where the first element 21*a* has a reflector and the second element has an optical type, for example infrared, emitter-receiver, as is also well known.

The opening sensors 21 according to this second variant have the advantage of very reliably detecting the closed or open state of the opening 1. The alarm system 10 can thus be automatically and systematically active once the closed state is detected.

According to a third variant, the opening sensor 21 combines:

- a movement sensor (measurement of displacement, velocity or acceleration), such as an accelerometer; and
- a position sensor (measurement of the closed position), such as a magnetic proximity sensor cited above or a terrestrial magnetic field sensor.

The opening event is defined by:

- a change of position separated from the previous opening event by the time between events greater than a minimum time, where this minimum time is preferably greater than a second time D2 (relating to the cancellation) defined below; or
- a change of position of the first element relative to a second element, where the second element is in the closed position of the opening; or
- by calculating an intermediate position of the opening by using both sensors (position sensor and movement sensor) and an opening event is confirmed if the intermediate position of the opening exceeds a first threshold, and a closing event is confirmed if the intermediate position of the opening is less than a second threshold, which corresponds to a hysteresis function which is reinitialized by the completely closed position detected by the position sensor.

The inhibition device 22 is suited for at least determining the presence of a person in the interior space near the opening 1.

According to a first variant, the inhibition device 22 is a simple button; the person needs to press said button before each opening event of the opening 1 for reporting their presence inside and therefore reporting in advance that the opening event of the opening 1 will correspond to an opening action done from inside the area, and therefore that this opening event is done by an authorized person and not an intruder.

According to a second variant, the inhibition device 22 is a volumetric sensor with which to detect a movement in a detection zone (volume) facing said volumetric sensor. This volumetric sensor, often called the pyroelectric sensor, usually comprises an optical system which divides the detection zone alternately into active and inactive zones, an infrared detector (suited to the infrared domain) which provides a movement signal, and electronic processing which detects variations of this signal and therefore movement of a person (infrared emitter) in the detection zone.

In this variant, the inhibition device 22 directly and autonomously detects the presence of a person in the detection zone by the movement of said person. The detection zone is then advantageously adjusted for detecting a portion of the interior space near the opening 1. For example, the detection zone will cover a projected portion of 2×2 m (on the floor) in front of this opening 1. The inhibition device 22 then has an inhibition distance of 2 m within which the detection will have the effect of avoiding emission of the detection signal by the electronic unit 23.

According to a third variant, the inhibition device 22 is a volumetric sensor with which to detect a movement in a detection zone (volume), only if said movement is a movement approaching the movement sensor device. In this variant, the processing electronics detect not only variations in the movement signal, but also determines:

Whether the variations correspond to a signal of a person who is approaching the volumetric sensor, i.e. a person coming from inside the area, and corresponding a priori to an authorized person; or whether the variations correspond to a signal of a person who is going away from the volumetric sensor, i.e. a person coming from outside the area, especially if there is no prior inverse approaching movement, and therefore corresponds to an unauthorized person (intruder).

In this case, the electronic unit 23 will only provide the detection signal if the presence detected by the inhibition device corresponds to a movement of said person away from said inhibition device.

According to a fourth variant, the inhibition device 22 is a camera which detects movement in a detection area (portion of the image), by processing of successive time images (for example by correlation between said portions of successive images).

According to fifth variant, the inhibition device 22 is a proximity sensor which detects a simple nearby presence, meaning short range, for example within 50 cm. For example, this proximity sensor is an infrared sensor or light-emitting diode (LED) of emissions/reception type advantageously placed near the handle.

The electronic unit 23 is connected to the opening sensor 21 and the inhibition device 22, receives their respective signals (respectively, opening event and presence of a person), and provides a detection signal:

1) if the opening sensor detected an opening event; and 2) if the inhibition device did not detect a presence during a first time D1 before the opening event.

"Provide a detection signal" is understood to mean provide a nonzero detection signal, meaning that a confirmed opening event has been detected, meaning emitting or transmitting a detection signal. The known operation of the alarm sensors provides a detection signal after the detection of an event and does not provide a signal if no event was detected. Because they are usually wireless type and self-powered by a battery or rechargeable battery, these detectors thus save energy.

The first time D1 is adjusted in an analog or digital way. It is for example included between 1 second and 10 minutes. It is for example of order 1 minute, such that any opening event preceded by a presence detection within the preceding minute will be deactivated and will not generate any detection signal.

Because of the preceding logic, the alarm sensor 20 according to the invention considers the opening event detected by the opening sensor 21 only if no presence had been detected by the inhibition device 22 during the first time D1 preceding the opening event.

Thus, all opening events caused by a person located in the space inside the area are inhibited or eliminated.

According to the five variants of the inhibition device 22 cited above, these opening events are inhibited or eliminated in order to generate the detection signal, respectively:

when the person inside has pressed on a button (inhibition device 22) during the first time D1 preceding the opening event;

when the person passes into the detection zone of the volumetric sensor (inhibition device 22) during the first time D1 preceding the opening event; or when the person passes into the detection zone of the volumetric sensor (inhibition device 22) by coming closer thereto during the first time D1 preceding the opening event.

In this third variant, if the person passes into the detection zone of the volumetric sensor (inhibition device 22) by going away therefrom, this presence detection will not be considered, and an opening event which could be detected would be considered pertinent for generating a detection signal and an alert. Further, preferably, the person going away has the effect of canceling the previous approach, such that the alarm sensor 20 does remain active even if the person inside the area approaches and goes away from the sensor.

With this logic, when opening events do not generate a detection signal, they will not generate an alert from the alarm system, i.e. a false alert. These opening events caused by a person located inside the area do not correspond to an intrusion, and are therefore assumed to be done by an authorized person.

The alarm sensor 20 according to this first embodiment is advantageously incorporated in a single sensor case 28 when the opening sensor 21 is composed of a single element. In this case, the sensor case 28 is suited for being attached onto the mobile part of the opening 1 (e.g. shape, dimensions, etc.). As a variant, the assembly of the second element 21*b*, inhibition device 22, and electronic unit 23 is incorporated in a single sensor case 28 as shown in FIG. 2. This sensor case 28 is then suited for being attached onto the fixed part of the opening 1 (e.g. shape, dimensions, etc.), or inversely.

Because of this alarm sensor 20 combining an opening sensor and an inhibition device, the false detection rate is sharply reduced.

This alarm sensor 20 can then be connected by a wired or wireless internal connection 29 (sensor-central unit connection) to an alarm central unit 30 as shown in FIG. 1. This alarm central unit 30 can be an alarm central unit such as currently known, or an alarm central unit 30 simplified and adapted only to the present alarm sensor 20.

FIG. 2 shows an alarm central unit 30 for the alarm sensor from the first embodiment. This alarm central unit 30 comprises:

- a central unit cancellation device 34 that is activated by the identification of an authorized person; and
- a central unit alert device 35 which generates an alert for reporting an intrusion to third parties (for example by siren, SMS message, etc.).

The central unit cancellation device 34 is suited for being activated by the identification of a person, and canceling the alert if the central unit cancellation device 34 was activated during a second time D2 after the opening event.

The second time D2 is adjustable in an analog or digital way. It is for example included between 10 seconds and 2 minutes. It is for example of order 1 minute, such that any alert is eliminated if a person identifies themself with the central unit cancellation device 34.

Typically, the central unit cancellation device 34 is:

- a contact badge reader, for example magnetic stripe reader type;
- a short distance badge reader, for example RFID or NFC type;
- a wireless reader suited to being paired with the mobile wireless electronic device, such as a mobile phone, connected watch, badge (electronic card, key ring);
- the keypad, for example key or touch type or other;
- a touch surface or touch screen, on which the user must make a gesture or predetermined shape for activating said cancellation device; or
- a biometric reader, for example fingerprint recognition, retina scan, voice recognition, facial recognition by camera or any other known biometric reader.

The "wireless" connection from the wireless reader uses a middle or long distance wireless transmission means (for example "Bluetooth" or "Low Energy Bluetooth").

Thus, in the case of a volumetric sensor type inhibition device 22 and a central unit cancellation device 34 or a cancellation device 24 (described based on FIG. 3) of the wireless reader type, the user does not have any action to take on entering the area (no deactivation or identification): the alarm central unit 30 is completely autonomous and determines itself the nature of the entry (confirmed intrusion or not).

Advantageously, this wireless technology is able to estimate the distance between the central unit cancellation device 34 and the wireless electronic device which is carried by the user.

For example, the distance is determined depending on:

- a transmitted power of the wireless electronic device, which could be previously recorded; and/or
- the transmission frequency of the wireless electronic device; and/or
- a preset table for said wireless electronic device.

In particular, identification can be confirmed (i.e. central unit cancellation device 34 activated) if said distance is shorter than a cancellation distance.

This cancellation distance is a parameter of the central unit cancellation device 34 or cancellation device 24, i.e. a parameter of the alarm sensor 20 and or the alarm central unit 30.

This cancellation distance is for example preset and for example less than 5 m and preferably less than 2 m. In this way cancellations for detection away from the alarm sensor 20, without control of the opening and possible intruders, are avoided.

This cancellation distance can be adjusted for each application, even adjusted to a value which deactivates said condition on distance between the central unit cancellation device 34 and the wireless electronic device, for example for an area with public access where at least one authorized person is located inside the area.

The cancellation distance is for example adjusted to a value less than the range of the wireless electronic device. The wireless electronic device uses a wireless transmission means which has a range, meaning the distance beyond which it is no longer detectable, i.e. a distance beyond which the cancellation device 24 of the central unit cancellation device 34 will no longer be able to detect it.

The cancellation distance can therefore either be adjusted to a value less than this range which serves to define the cancellation distance for the alarm system or by the range itself which is the same as setting the cancellation distance to a very large value. In this last case, if the central unit cancellation device 34 or cancellation device 24 (described starting with FIG. 3) does not detect the wireless electronic device during a second time D2 after the opening event, the electronic unit 23 can provide a detection signal according to the validity of other conditions. In other words, if the cancellation device 24 or the central unit cancellation device 34 detects the wireless electronic device during the second time D2 after the opening event, there is no detection signal.

As a variant, the wireless electronic device communicates an identifier to the cancellation device 24 or the central unit cancellation device 34 and it determines the cancellation distance depending on this identifier.

Thus, if several wireless electronic devices are used, each one can have a different cancellation distance.

Advantageously, the wireless reader is near the alarm sensor 20, such that the distance between the wireless reader and the wireless electronic device is substantially equal to the distance between the alarm sensor 20 and the wireless electronic device.

Further the wireless electronic device could be remotely programmable by the wireless connection thereof with the central unit 30. For example, the range of the wireless electronic device could be adjusted by changing the emitted power. The range of the wireless electronic device can then be adjusted to a value slightly farther than the cancellation distance in order to maximally reduce the energy consumption of the wireless electronic device.

Thus, the authorized person who opens the opening 1 from the outside for entering into the area must activate the central unit cancellation device 34 or the cancellation device 24 inside the area quickly, meaning before the end of the second time D2 which starts the moment of the opening event. This action on the central unit cancellation device 34 cancels the generation of the alert by the alarm central unit 30. It could be a wireless electronic device paired with the cancellation device which must activate the central unit cancellation device 34 or the cancellation device 24 quickly, before the end of the second time D2, which amounts to activating an automatic cancellation.

Further, the alarm sensor 20 and/or the alarm central unit 30 are designed for being in energy-saving sleep mode over most of the time of operation thereof.

In fact, the opening sensor 21 and/or the inhibition device 22 are continuously active and are able to change the electronic unit 23 of the alarm sensor 20, the central unit electronic unit 33 of the alarm central unit 30, and the cancellation device 24 or the central unit electronic device 34 from sleep mode to active mode. After an inaction time following a last event, the electronic unit 23 and the cancellation device 24, 34 automatically return to sleep mode.

Because of this operation, the alarm sensor 20 and/or the alarm central unit 30 consume little energy.

The central unit alert device 35 is the device which generates the alert for reporting and/or informing one or more third parties that the area was the victim of an intrusion.

"Alert" is therefore understood to be a signal which is issued to warn people that an intrusion (i.e. an unauthorized, meaning unidentified, intrusion) has taken place and that consequently verifications and/or a response are to be done quickly.

Typically, this central unit alert device 35 is:

- a siren which generates a sound and/or a light signal;
- a communication member suited for sending the alert to a remote device, such as a telephone; or
- a combination of these devices, in which case, the alert is made up of a first alert generated by a siren and a second alert generated by the communication member; advantageously, the second alert is generated after the first alert, for example after the expiration of a time between 10 seconds and 1 minute for possibly leaving more time for users to actuate the central unit cancellation device 34 before sending the second alert to the remote device (response by a security agent).

The communication member for example sends the alert by an external connection 39 (alarm system to remote device connection, i.e. alarm system to user or alarm system to security agent):

- by wire: ethernet, ADSL, fiber-optic or cable type; or
- by wireless: Wi-Fi, GSM, Internet of things (e.g. LoRa network, SIGFOX network) type.

In particular, the central unit alert device 35 may for example send an SMS notification to a portable telephone type remote device. Such a notification or "push" notification uses a notification server which is an intermediary between the central unit alert device and the remote device. This notification server is not shown in the figures for reasons of simplification.

Further, the central unit alert device 35 can also send information messages, different from alerts, through the communication member for informing a person of entry/exit events for the area. These information messages therefore differ from the alerts which correspond to an unauthorized intrusion.

The alarm central unit 30 according to this first embodiment is advantageously incorporated in a single central unit case 38.

Thus, according to this first embodiment, the alarm system 10 advantageously comprises two modules:

- a first alarm sensor module 20 incorporating the opening sensor 21 and the inhibition device 22, formed of just one or of two cases 28; and
- a second alarm central unit module 30 incorporating the central unit cancellation device 34 and the central unit alert device 35, formed of just one case 38.

Each of these modules and/or cases can then be small, which makes the installation thereof easier.

Advantageously, the first module is placed on the fixed or mobile part of the opening and the second module is placed on the wall near the opening (for example at arm height in order to be accessible so that the authorized person can easily activate alert cancellation). If the inhibition device 22 is a button, the first module will be placed in the lower part, at arm height in order to be accessible, otherwise the first module will preferably be placed in the upper part to be less visible.

For comparison with known alarm systems, the alarm central unit 30 for this system can remain active and protection is continuous. Because of this alarm system 10, the alert can be sent directly to the relevant security agent, which reduces the response time.

Figure 3:
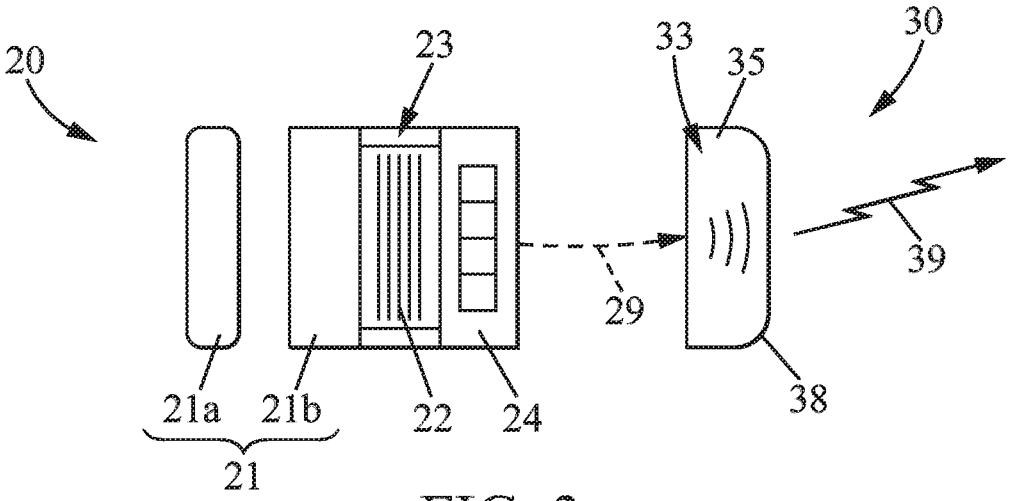
FIG. 3 is a schematic view of a second embodiment of an alarm system according to the invention.

FIG. 3 shows an alarm system 10 comprising an alarm sensor 20 for an opening and the central alarm unit 30 according to a second embodiment of the invention.

The alarm system 20 comprises the same elements as in the first embodiment, specifically:

- an opening sensor 21 which detects an opening event of the opening 1;
- an inhibition device 22 which detects the presence of a person in the interior space near the opening 1; and
- an electronic unit 23 connected to the opening sensor 21 and the inhibition device 22 and which generates a detection signal.

In this second embodiment, the alarm sensor 20 additionally comprises:

- a cancellation device 24, equivalent to the central unit cancellation device 34 from the first embodiment. This cancellation device 24 is thus suited for being activated by the identification of the person.

The cancellation device 24 can also be of the type previously listed in the first embodiment (for the central unit cancellation device 34).

As before, this alarm sensor 20 considers the opening event detected by the opening sensor 21 only if no presence had been detected by the inhibition device 22 during the first time D1 preceding the opening event.

Thus, all opening events caused by a person located in the space inside the area are inhibited or eliminated.

Because of this alarm sensor 20 combining an opening sensor, an inhibition device, and a cancellation device, the false detection rate is sharply reduced.

This alarm sensor 20 can then be connected by a wired or wireless internal connection 29 to an alarm central unit 30. This alarm central unit 30 can be an alarm central unit such as currently known, or an alarm central unit 30 simplified and adapted only to the present alarm sensor 30 as shown in FIG. 3.

The simplified alarm central unit 30 for this second embodiment does not comprise a central unit cancellation device 34, as compared with that from the first embodiment.

The alarm central unit 30 therefore comprises a central unit alert device 35 which is able to generate the alert for notifying or informing one or more third parties that the area was the victim of an intrusion. Further, this alarm central unit 30 considers the detection signal and possibly the activation information from the cancellation device 24, supplied by the alarm sensor 20 via the internal connection 29.

The central unit alert device 35 can also be one of the type previously listed in the first embodiment, and have an operation of the same type.

According to a first variant, the cancellation device 24 is connected to the electronic unit 23 which itself cancels the alert if the cancellation device 24 was activated during a second time D2 after the opening event.

According to a second variant, the cancellation device 24 sends activation thereof to the alarm central unit 30 directly or indirectly via the electronic unit 23 to a central unit electronic unit 33, which then cancels the alert if the cancellation device 24 was activated during a second time D2 after the opening event. This second variant provides greater security because cancellation of the alert is done in the alarm central unit 30 which can be easily concealed in the area and difficult to access by an intruder who may want to destroy it.

Thus, according to this second embodiment, the alarm system 10 advantageously comprises two modules:

- a first alarm sensor module 20 incorporating the opening sensor 21, the inhibition device 22, the electronic unit 23 and the cancellation device 24, formed of just one or of two cases 28; and
- a second alarm central unit module 30 incorporating the central unit alert device 35, formed of just one case 38.

Each of these modules and/or cases can then be small, which makes the installation thereof easier.

Advantageously, the first module is placed on the fixed or mobile part of the opening and the second module can be placed at any location in the area or nearby.

The first alarm sensor module 20 can be a generic module which can be connected by internal link 29 to any type of alarm central unit 30 if it incorporates cancellation of the detection signal or at the simplified alarm central unit as explained above.

For comparison with known alarm systems, the alarm central unit 30 for this system can remain active and protection is continuous. Because of this alarm system 10, the alert can be sent directly to the relevant security agent, which reduces the response time.

Advantageously, the cancellation device 24 is a wireless reader paired (connected by a wireless link) with a wireless, mobile electronic device. The wireless connection uses a middle or long distance wireless transmission means (for example "Bluetooth" or "Low Energy Bluetooth").

In the case of a volumetric sensor type inhibition device 22 and a central unit cancellation device 34 or a cancellation device 24 of the wireless reader type, the user does not have any action to take on entering the area (no deactivation or identification): the alarm central unit 30 is completely autonomous and determines itself the nature of the entry (confirmed intrusion or not).

Figure 4:
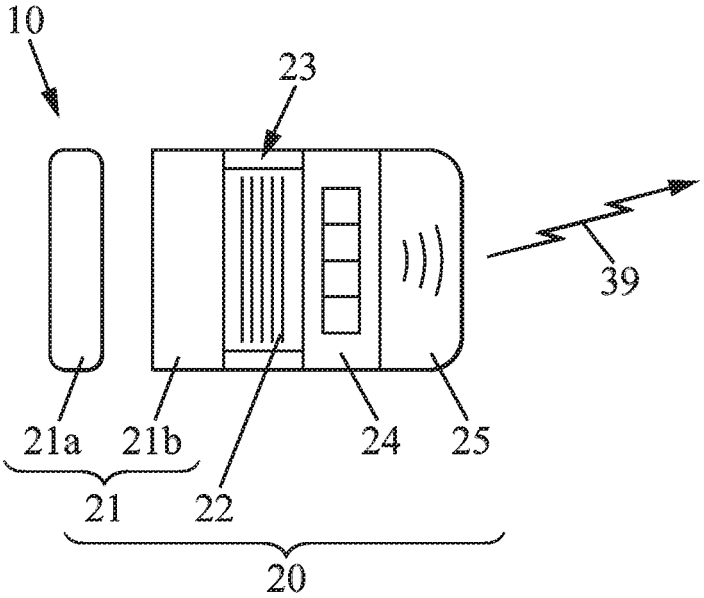
FIG. 4 is a schematic view of a third embodiment of an alarm system according to the invention.

FIG. 4 shows an alarm system 10 comprising an alarm sensor 20 for an opening and the central alarm unit 30 according to a third embodiment of the invention.

The alarm system 20 comprises the same elements as in the second embodiment, specifically:

- an opening sensor 21 which detects an opening event of the opening 1;
- an inhibition device 22 which detects the presence of a person in the interior space near the opening 1;
- an electronic unit 23 connected to the opening sensor 21 and the inhibition device 22 and which generates a detection signal; and
- a cancellation device 24 which is activated by identification of the person.

In this second embodiment, the alarm sensor 20 additionally comprises:

- an alert device 25, equivalent to the central unit alert device 35 from the second embodiment, and is suited to generate the alert for notifying or informing one or more third parties that the area was the victim of an intrusion.

The alert device 25 can be one of the type previously listed in the first or second embodiments (the central unit alert device 35), and have an operation of the same type.

Thus, the alarm sensor 20 cancels the alert if the cancellation device 24 were activated during the second time D2 after the opening event and could generate the alert.

As before, this alarm sensor 20 considers the opening event detected by the opening sensor 21 only if no presence had been detected by the inhibition device 22 during the first time D1 preceding the opening event.

Thus, all opening events caused by a person located in the space inside the area are inhibited or eliminated.

Because of this alarm sensor 20 combining an opening sensor, an inhibition device, a cancellation device, and an alert device, the false detection rate is sharply reduced.

Finally, the alarm sensor 20 for this third embodiment is in fact a complete and autonomous alarm system 10, because it incorporates the essential function of the alarm central unit 30, meaning the alert device which reports the intrusion to a third party for example located away from the area.

Advantageously, this alarm sensor or system 10 is incorporated in a single case, which makes installation thereof easy.

For comparison with known alarm systems, the alarm central unit 30 for this system can remain active and protection is continuous. Because of this alarm system 10, the alert can be sent directly to the relevant security agent, which reduces the response time.

Figure 5:
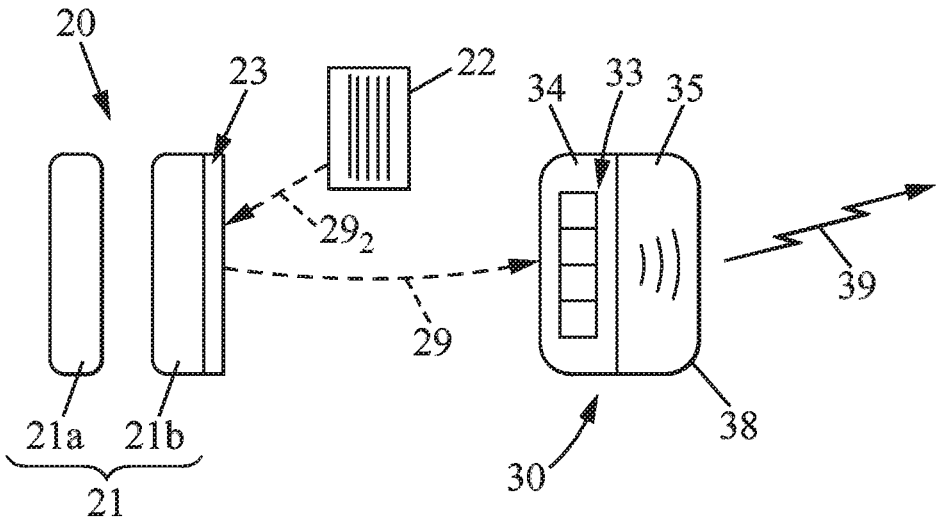
FIG. 5 is a schematic view of a fourth embodiment of an alarm system according to the invention.

FIG. 5 shows an alarm system 10 comprising an alarm sensor 20 for an opening and the central alarm unit 30 according to a fourth embodiment of the invention.

The alarm system 20 comprises the same elements as in the first embodiment, specifically:

- an opening sensor 21 which detects an opening event of the opening 1;
- an inhibition device 22 which detects the presence of a person in the interior space near the opening 1; and
- an electronic unit 23 connected to the opening sensor 21 and the inhibition device 22 and which generates a detection signal.

In this fourth embodiment, the inhibition device 22 is connected by a second wired or wireless internal link $\mathbf{29}_2$ to the electronic unit 23 of the alarm sensor 20.

This inhibition device 22 can be of any type, such as those cited in the first embodiment. For example, the inhibition device 22 is a wireless volumetric sensor or a wireless camera with which to detect the presence of a person in the inside space near the opening 1.

Because of this disposition, the alarm sensor 20 comprises a sensor case 28 which includes only the opening sensor 21 and the electronic unit 23. This sensor case 28 can be smaller size and the installation is easier. Further the inhibition device 22 could already be available, and thus this embodiment is less costly.

As before, this alarm sensor 20 considers the opening event detected by the opening sensor 21 only if no presence had been detected by the inhibition device 22 during the first time D1 preceding the opening event.

Thus, all opening events caused by a person located in the space inside the area are inhibited or eliminated.

Because of this alarm sensor 20 combining an opening sensor 21 and an inhibition device 22 by a second internal link $\mathbf{29}_2$, the false detection rate is sharply reduced.

Figure 6:
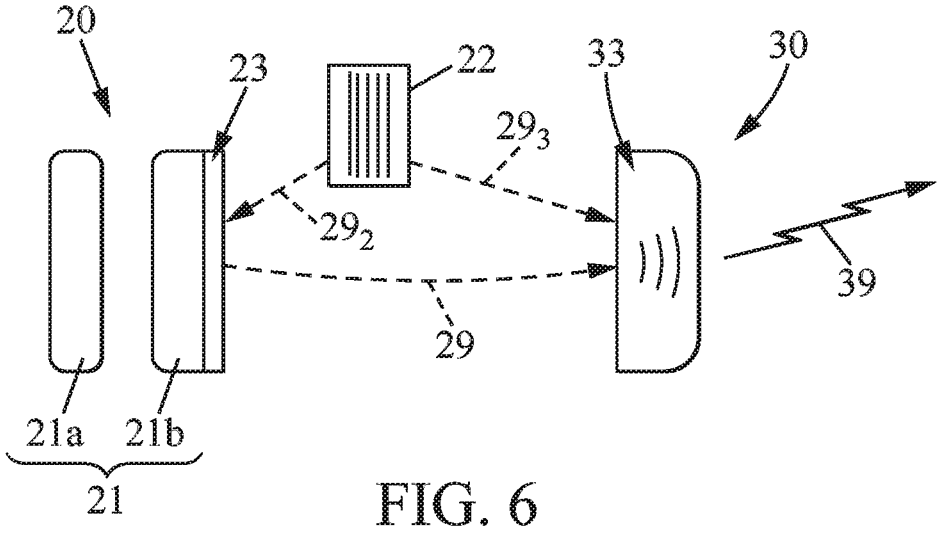
FIG. 6 is a schematic view of a fifth embodiment of an alarm system according to the invention.

FIG. 6 shows an alarm system 10 comprising an alarm sensor 20 for an opening and the central alarm unit 30 according to a fifth embodiment of the invention.

This fifth embodiment differs from the fourth embodiment and the preceding in that the inhibition device 22 is able to also perform the function of the cancellation device 24 from the second and third embodiments, or the central unit cancellation device 34 from the first embodiment.

Structurally, the inhibition device 22 is connected by a second wired or wireless internal link $\mathbf{29}_2$ to the electronic unit 23 of the alarm sensor 20 and by a third wired or wireless internal link $\mathbf{29}_3$ to the central electronic unit 33 of the alarm central unit 30.

The inhibition device 22 is thus suited for at least determining the presence of a person in the interior space near the opening 1, and also for being activated by the identification of the person.

For example, if this inhibition device 22 is a camera, it can detect the presence of a person near the opening 1, but also identify whether this person is an authorized person such that the central unit electronic unit 33 cancels the alert.

The alarm system 10 from this embodiment has the advantages and effects of the fourth embodiment. As before, this alarm sensor 20 considers the opening event detected by the opening sensor 21 only if no presence had been detected by the inhibition device 22 during the first time D1 preceding the opening event.

Thus, all opening events caused by a person located in the space inside the area are inhibited or eliminated.

Because of this alarm sensor 20 combining an opening sensor 21 and an inhibition device 22 by a second internal link $\mathbf{29}_2$, the false detection rate is sharply reduced.

Because of the inhibition device 22 thereof which incorporates the function of the cancellation device, the alarm system is simpler to install and it is less costly.

Figure 7:
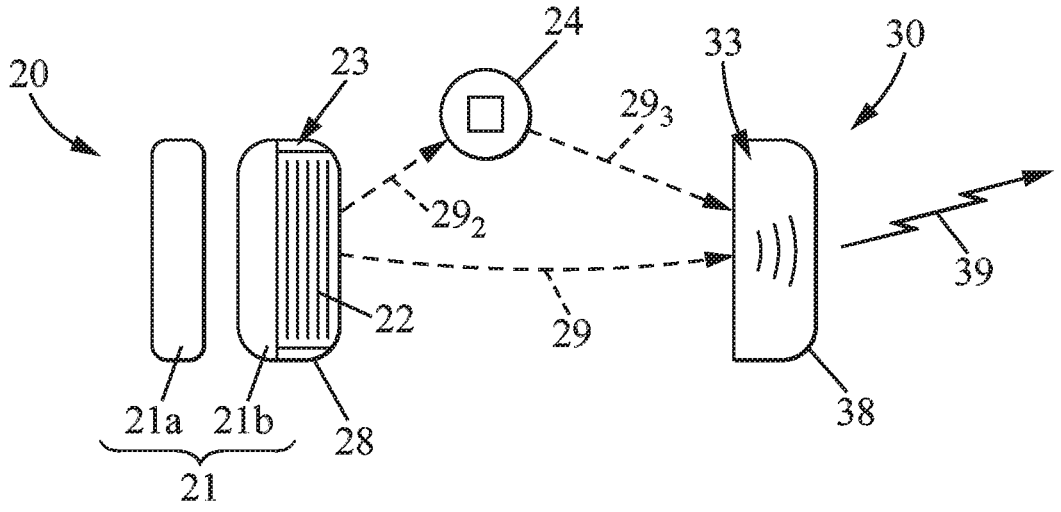
FIG. 7 is a schematic view of a sixth embodiment of an alarm system according to the invention.

FIG. 7 shows an alarm system 10 comprising an alarm sensor 20 for an opening and the central alarm unit 30 according to a sixth embodiment of the invention.

In this sixth embodiment, the cancellation device 24 is connected by a second wired or wireless internal link $\mathbf{29}_2$ to the electronic unit 23 of the alarm sensor 20.

This cancellation device 24 can be of any type, such as given in the first embodiment (central unit cancellation device 34) or in the following embodiments. For example, it is a wireless camera.

Structurally, the cancellation device 24 is connected by a second wired or wireless internal link $\mathbf{29}_2$ to the electronic unit 23 of the alarm sensor 20 and possibly by a third wired or wireless internal link $\mathbf{29}_3$ to the central electronic unit 33 of the alarm central unit 30.

Because of this disposition, the alarm sensor 20 comprises a sensor case 28 which includes the opening sensor 21, the inhibition device 22 and the electronic unit 23. This case has a reduced size, which makes installation thereof near the opening 1 easier. Further the cancellation device 24 could already be available in the area, and thus this embodiment is less costly. The alarm central unit 30 can also be simplified, with a central unit case 38 of very reduced size and easily concealable.

As before, this alarm sensor 20 considers the opening event detected by the opening sensor 21 only if no presence had been detected by the inhibition device 22 during the first time D1 preceding the opening event.

Thus, all opening events caused by a person located in the space inside the area are inhibited or eliminated.

Because of this alarm sensor 20 combining an opening sensor 21, an inhibition device 22 and a cancellation device 24, like a facial recognition camera, by a second internal connection $\mathbf{29}_2$, the identification of the authorized person can be automated, without manual involvement. The false detection rate is sharply reduced, and the use of the system is simplified.

In the various embodiments presented, when the cancellation device 24 is activated by identification of the person, said cancellation device 24 could generate and provide an identification signal.

"Provide an identification signal" is understood to mean provide a nonzero identification signal, meaning that the identification of a person has been done by the cancellation device 24, meaning send or transmit an identification signal. This identification signal can take several forms.

According to a first variant, the identification signal includes a code. The electronic unit 23 of the alarm sensor 20 or the central unit electronic unit 33 or any other electronic unit of the alarm system receives this identification signal and performs a comparison with one or more codes corresponding to authorized individuals for confirming the identification:

- the electronic unit 23 generates the detection signal if this identification is not confirmed (cancellation device not activated) during the second time D2 after the opening event; or
- the central unit electronics 33 receives the identification signal and cancels the alert if the identification is not confirmed during the second time D2 after the opening event.

According to a second variant, the identification signal is a confirmed identification information, where the identification of the authorized person is done directly by the cancellation device 24.

In the various embodiments presented, when the opening 1 is a window, no opening from the outside is normally expected (apart from intrusion). Variants without any cancellation device 24 could therefore be used.

Thus, the six embodiments of the alarm system 10 presented above comprise similar or identical elements distributed differently in various cases or modules. Further, these embodiments all operate identically. The alarm system 10 remains active continuously, which avoids forgetting to activate it when leaving the area. Further, the false alarm rate is greatly reduced because of the combination of the opening sensor and the inhibition device.

For comparison with known alarm systems, the alarm central unit 30 for this system can remain active and protection is continuous. Because of this alarm system 10, the alert can be sent directly to the relevant security agent, which reduces the response time.

Figure 8:
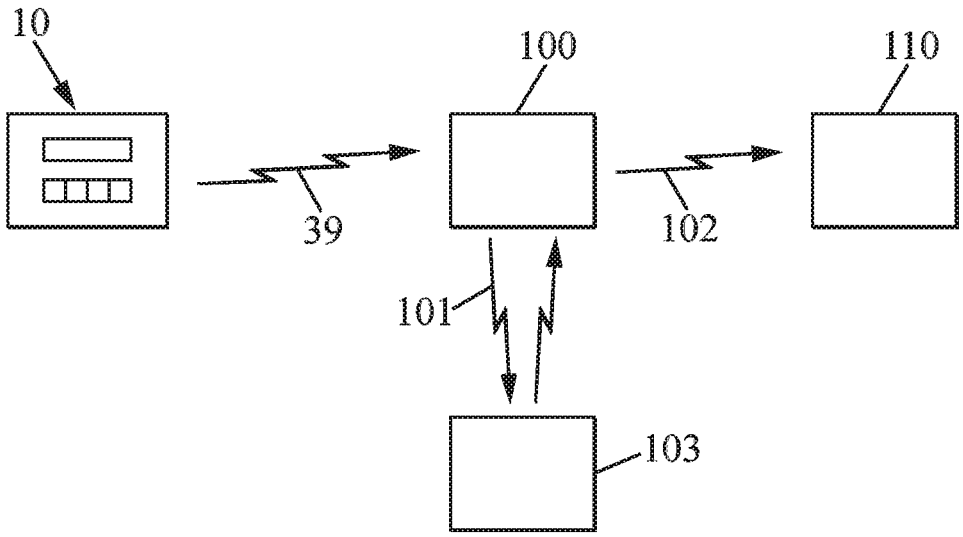
FIG. 8 is a diagram showing a method for use of an alarm system according to the prior art.
Figure 9:
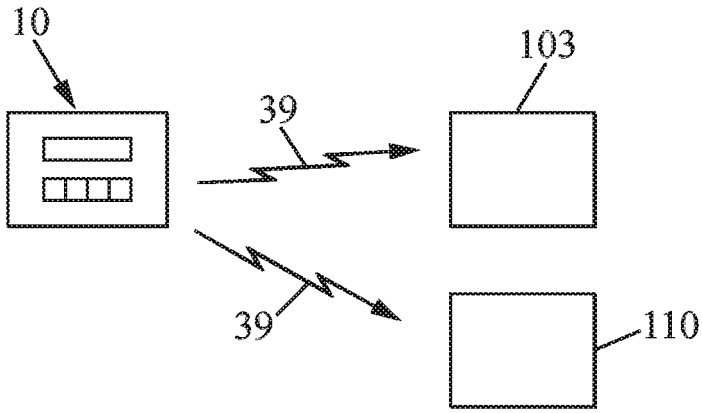
FIG. 9 is a diagram showing a method for use of an alarm system according to the invention.

The alarm systems 10 according to the present invention are therefore used according to a method shown in the diagram from FIG. 9 which is different from a method for use of an alarm system from the prior art shown in the diagram from FIG. 8.

In fact, an alarm system 10 according to the prior art shown in FIG. 8 is used according to a method which includes, following the generation of an alert by the alarm system, the following successive steps (FIG. 8):

a) The alarm system 10 located in the area to be protected transmits the alert via the external connection 39 to a remote monitoring manager 100;

b) The remote monitoring manager 100 gets in contact with an authorized person 103, for example by a telephone call 101, in order to verify whether there was a false alert;

c) If the authorized person has no explanation for the alert generated, the remote monitoring manager sends the alert through another external connection 102 to a security agent 110 located in a region that covers said alarm system; and d) the security agent 110 receives the alert sent in step c) by the remote monitoring manager and acts on the area of said alarm system 10.

This method causes time to be lost before the response can be started.

Thus, the alarm system 10 according to the prior art has a very reduced number of false alerts; it is used according to a method which includes, following the generation of an alert by the alarm system 10, the following successive steps (FIG. 9):

a) the alarm system 10 located in the area sends the alert to a security agent 110 located in a region that covers said alarm system; and b) the security agent 110 receives the alert sent in step a) and responds to the area of said alarm system 10.

This method is quicker and reduces the time between generation of the alert and the response.

The method could further comprise a step in which:

c) the alarm system 10 sends the alert to the authorized person 103, for example after having sent said alert to the security agent 110.

Said alert is for example sent to the authorized person's mobile electronic device, such as a mobile phone, by an SMS or a "push" notification.

Further, the authorized person 103 could have a means suited for communicating with the security agent 110 and for canceling the alert sent in step a). This cancellation can be done:

- directly between said means of the authorized person 103 and the security agent 110; or
- indirectly by a first transmission to the alarm system 10 for cancellation of said means, and then the relay of this cancellation by a second transmission from the alarm system 10 to the security agent 110.

Because of this means, the cost for the response can be reduced.

This means is for example said mobile electronic device of the authorized person 103 in which an application was installed for performing this alert cancellation. This application can possibly retain a history of all alerts and alarm system 10 messages.

Adjustment variants of the cancellation distance of the cancellation device 24 or the central unit cancellation device 34 are now going to be described in more detail.

Determining in advance an adequate value for the cancellation distance can be difficult. In particular in the case of the use of a wireless electronic device in relation to the cancellation device 24 of the alarm sensor 20 or the central unit cancellation device 34 of the alarm central unit 30:

- if the cancellation distance is too short, the cancellation device 24 can have difficulties detecting and/or identifying a person upon entering into the area; and
- if the cancellation distance is too long, there is a risk that the person using it leaves their wireless electronic device continuously in range of the cancellation device 24 (at a distance shorter than the cancellation distance) after entering.

The cancellation device 24 for the present variant records resting distances which are distances between the wireless electronic device and the cancellation device 24 which are kept (which remain substantially constant) for a time longer than a third time D3. This third time D3 is for example 5 minutes or 10 minutes.

The cancellation device 24 then adjusts the cancellation distance itself to a value shorter than all the recorded resting distances. The cancellation distance is for example adjusted to a value 20% below the shortest resting distance.

The cancellation device 24 could regularly eliminate the oldest resting distances. For example, any resting distance recorded over two weeks or over one month ago will be eliminated.

Thus, because of the preceding dispositions, the cancellation device 24 is capable of automatically shortening and lengthening the cancellation distance, meaning automatically adapting the cancellation distance.

Further, the cancellation distance can also identify different resting distances for each wireless electronic device, and therefore a cancellation distance for each wireless electronic device.

Further, the cancellation distance can be limited by a minimum value, a minimum cancellation distance for guaranteeing sufficiently effective detection of the cancellation device 24. For example, the minimum cancellation distance is 1 m.

Management variants (monitoring methods) for one or more wireless electronic devices by the cancellation device 24 or the central unit cancellation device 34 are now going to be described in more detail.

The use of the wireless electronic device in connection with the cancellation device 24 of the alarm sensor 20 or the central unit cancellation device 34 of the alarm central unit 30 can pose problems if the user leaves this wireless electronic device near the alarm sensor or the alarm central unit, in a zone called cancellation zone, for example at a distance shorter than the cancellation distance. In this case, the cancellation device 24 would be systematically activated, which systematically deactivates the detection signal, which continuously deactivates the alarm sensor and/or the alarm central unit and cancels any protection.

To overcome this difficulty, a wireless electronic device which remains in the cancellation zone for too long is temporarily deactivated. However, this deactivation must be certain, without that there is a risk of false alerts. This management or method of monitoring the wireless electronic devices is described with a single electronic device, but is immediately generalizable to several wireless electronic devices.

According to a first variant of this monitoring method:

- if the wireless electronic device is detected for a time longer than a fourth time D4 or detected at a distance shorter than the cancellation distance for a time greater than a fourth time D4, the wireless electronic device is deactivated, which means that it can no longer activate the cancellation device 24 (temporarily); and
- if the wireless electronic device is not detected, the wireless electronic device is activated which means that it can activate the cancellation device.

The cancellation distance is a parameter of the alarm sensor 20 and/or the alarm central unit 30.

The fourth time is for example 10 minutes, which means that the wireless electronic device has been placed for a long time.

According to a second variant of the monitoring method, more or less equivalent to the preceding one, the cancellation device 24, 34 does presence analyses for the wireless electronic device, repetitively at an analysis period, and with each analysis:

- if the wireless electronic device is detected or detected at a distance shorter than the cancellation distance, a counter is incremented;
- if the counter is over a threshold value (for example a threshold value of 2 or 3), the electronic device is deactivated, which means that it can no longer activate the cancellation device;

if the wireless electronic device is not detected, the counter is reset to an initial value (for example 0) and the wireless electronic device is activated which means that it can activate the cancellation device.

According to this variant, the cancellation device 24, 34 can change the analysis period. In particular, after the detection of the opening event, the analysis period can be adjusted to a first value, for example short, for example 2 minutes, then after a predetermined number of analyses, the analysis period is adjusted to a second value longer than the first value, for example 10 minutes.

In this way, the cancellation device 24 observes the presence of the wireless electronic device more finely after the opening event, which corresponds to a moment when the wireless electronic device is moving.

Figure 10:
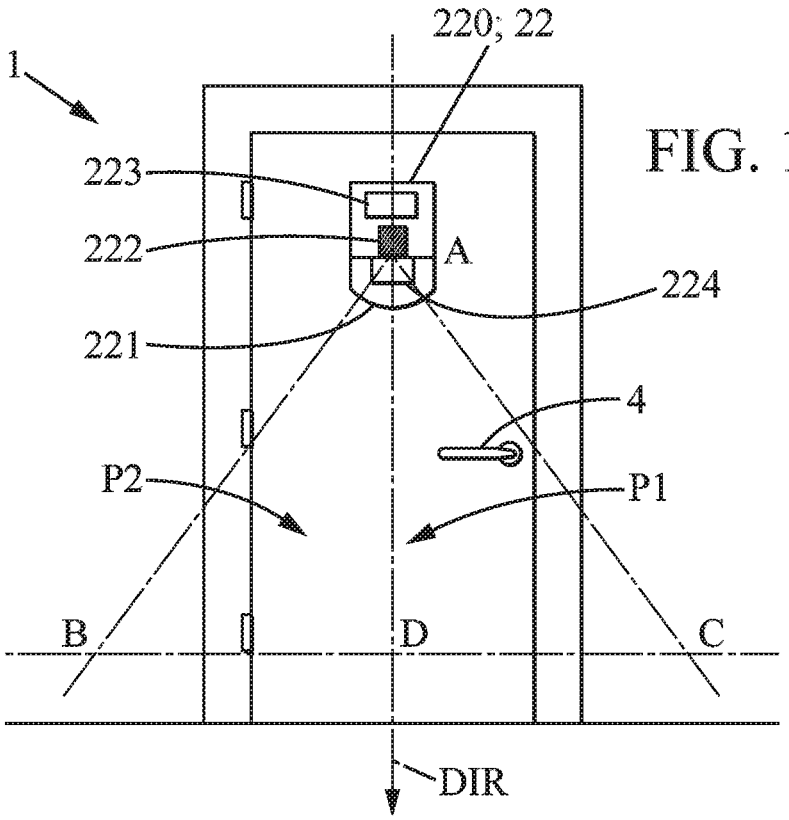
FIG. 10 is a schematic view, front view of an embodiment comprising a volumetric sensor type inhibition device.

Variants of an inhibition device 22 of volumetric sensor 220 type are now going to be described in more detail with reference to FIGS. 10 and 11, in which the volumetric sensor is represented schematically very large to be able to see the details thereof.

As already explained, a volumetric sensor 220 comprises:

an optical system 221 which divides the detection zone alternately into active and inactive zones;

an infrared detector 222 aligned with the optical system 221 and which provides a movement signal; and processing electronics 223 which detect variations in this signal, where said variations mean a movement of a person in the detection zone.

More precisely, the infrared detector 222 is composed of two detection elements 222*a*, 222*b* comprising a pyroelectric material sensitive in the infrared optical domain. The difference calculated between a first signal coming from the first detection element 222*a* and a second signal coming from the second detection element 222*b* is done for example by the processing electronics 223 which then provides the movement signal.

Generally, the infrared detector 222 has the following properties:

a first plane P1, in which the alternation of active and inactive zones has a relatively large density (more than 10 and often more than 20 alternations) which gives a good sensitivity to transverse movement compared to the volumetric sensor, where this first plane P1 corresponds to a plane perpendicular to the infrared detector 222 and passing through the two detection elements 222*a* and 222*b*; and a second plane P2 perpendicular to the first plane P1, in which the alternation of active and inactive zones has a relatively small density (fewer than 10 alternations), which gives a less good sensitivity to longitudinal movement compared to the volumetric sensor (in the direction of moving away from the sensor), where this second plane P2 corresponds to a plane perpendicular to the infrared detector 222 and passing between the two detection elements 222*a*, 222*b*.

In the figures, the first plane P1 is defined by the points A, D, and E, and the second plane P2 is defined by the points A, B, and C.

Typically, the first plane P1 is positioned substantially parallel to the floor or the flooring of the room (i.e. horizontal) compared to the floor, and the second plane P2 is positioned substantially perpendicular to the floor (i.e. vertical).

According to a first variant, not shown in the figures, the inhibition device 22 is a volumetric sensor placed as usual, meaning with the first plane P1 thereof substantially parallel to the floor of the area, and the second plane P2 thereof substantially perpendicular to the floor.

According to a second variant, shown in the figures, the inhibition device 22 is a volumetric sensor 220 placed with the first plane P1 thereof (with higher movement detection density) substantially perpendicular to the floor of the area, for example at plus or minus 20° relative to a perpendicular to the floor. Thus, this first plane P1 is substantially vertical. Further, the second plane P2 thereof is usually perpendicular to the first plane P1. Thus, the second plane is substantially horizontal (within the same angular range).

Because of this positioning, the inhibition device 22 is more sensitive for detecting a person who is coming towards or going away from said inhibition device 22.

Further, the inhibition device 22 can be directed towards the inner handle 4 of the opening 1 or towards a zone near said handle 4. The direction D of the volumetric sensor 22 is defined by the intersection of the first plane P1 and the second plane P2, and therefore corresponds to an orientation of the infrared detector 222 thereof and the optical system 221 thereof.

Because of this orientation, the inhibition device 22 detects the hand of the person approaching the inner handle 4 of the opening 1.

Further the volumetric sensor 220 has, for example, in this last scenario a first opening angle al in the first plane P1 that is less than 60°, and for example less than 45° and possibly less than 20°.

Because this first opening angle al in the first plane P1 is reduced compared to known sensors, the inhibition device 22 more precisely detects the hand approaching the inner handle 4.

In contrast, the volumetric sensor 220 has for example a second opening angle a2 in the second plane P2 that is over 90° and for example 120° or more.

This second angle of opening a2 in the second plane P2 is therefore expanded compared to the known sensors, which allows the detection over a large width of the handle and opening 1.

Thus, this volumetric sensor 220 has features or a use inverted compared to known volumetric sensors. This volumetric sensor 220 effectively detects the movement of a person or the hand of a person coming towards or going away from the opening 1 or the handle 4 of the opening. Thus, the detection zone is better targeted. Thus, the false detection rate is sharply reduced.

For example, the volumetric sensor 220 from the second variant further includes a wall 224 position substantially perpendicularly to the infrared detector 222, between the two detection elements 22*a*, 22*b*. This wall extends over a separation height going away from said infrared detector 222. The wall 224 is, for example, a metal or plastic sheet. This wall has a spatial masking effect on the infrared rays.

Figure 11:
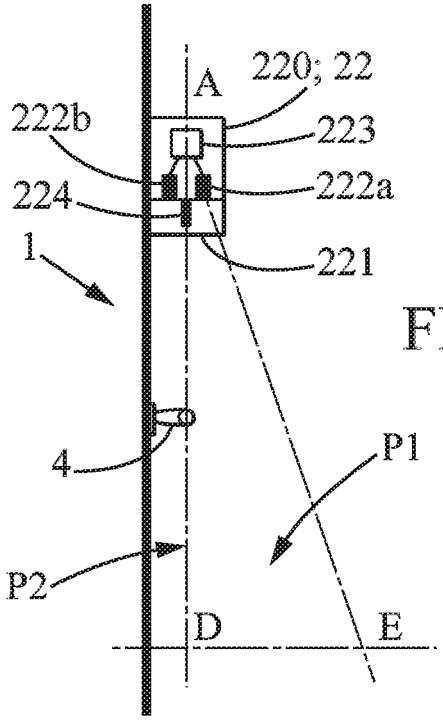
FIG. 11 is a schematic side view of the embodiment from FIG. 10.

If the first detection element 22*a* is located farther from the opening 1 than the first detection element 22*b*, as shown in FIG. 11, the first signal will have a temporal variation before the second signal, while the hand passes, and the difference between the first and second signals will have a greater variation, which increases the sensitivity of the volumetric sensor 222 in the first plane P1.

For example, in particular in the case of a volumetric sensor with the wall cited above, the volumetric sensor will not include an optical system like lenses, since these lenses are replaced by the simple wall. The inhibition device thus made will be both more sensitive, more compact, more aesthetic and less costly than the known sensors.

Finally, the alarm system 10 according to the invention is active continuously, which avoids forgetting to activate it when leaving the area.

In exceptional cases, it can however be useful to be able to temporarily deactivate it, for example, when frequent entering and exiting are temporarily expected and the one or more users do not wish to have to activate the cancellation device 24 on each entry, or do not wish to have to continuously wear a wireless electronic device which automatically activates the cancellation device 24.

The alarm sensor 20 and/or the alarm central unit 30 comprise a deactivation means for doing this temporary activation/deactivation. This action does not require identification of the person, from the moment that this action is done outside of any entry into the area, i.e. done at a time not consecutive to such an entry. This deactivation means can be a button. This deactivation means could be supplemented by an alert means which warns the one or more users that the alarm sensor 20 and/or the alarm central unit 30 are inactive, and that the area is not protected. This alert means can be a visual indication (e.g. an LED) or sonic indication or an alert sent to the one or more wireless electronic devices or an alert sent to one or more mobile phones. These indications and/or alerts could be sent regularly.

The invention claimed is:

1. An alarm sensor for an opening of a building area, said opening comprising a fixed part surrounding an opening and a mobile part suited for opening or closing said opening, where said opening is located between an interior space and an exterior space of the area and where said alarm sensor is suited to provide a detection signal and comprises:

an opening sensor suited for detecting an opening event of the opening;

an inhibition device suited for at least determining a presence of a person in the interior space near the opening;

a cancellation device suited for being activated by an identification of a person; and an electronic unit suited for providing the detection signal:

1) if the opening sensor detected the opening event; and 2) if the inhibition device did not detect a presence during a first time before the opening event; and 3) if the cancellation device was not activated during a second time after the opening event.

2. The alarm sensor according to claim 1, wherein the cancellation device is a wireless reader suited for being wirelessly connected to a wireless electronic device.

3. The alarm sensor according to claim 2, wherein the wireless electronic device has an average wireless emission which has a range which is a maximum detection distance, and the cancellation device sends the wireless electronic device an adjustment value for said range of the wireless electronic device.

4. The alarm sensor according to claim 2, wherein the cancellation device can be activated if it detects the presence of the wireless electronic device.

5. The alarm sensor according to claim 2, wherein the wireless reader estimates a distance between said wireless reader and the wireless electronic device.

6. The alarm sensor according to claim 5, wherein the cancellation device can be activated only if the distance is shorter than a cancellation distance.

7. The alarm sensor according to claim 6, wherein the cancellation distance is less than 2 m.

8. The alarm sensor according to claim 6, wherein the cancellation distance depends on an Identifier from the wireless electronic device.

9. The alarm sensor according to claim 6, wherein the cancellation distance is determined depending on previously detected resting distances, where a resting distance is the distance between the wireless reader and the mobile electronic device which is stored for a time greater than a third time and where the cancellation distance is then shorter than any resting distance.

10. The alarm sensor according to claim 2, wherein the cancellation device performs a method of monitoring wireless electronic devices, during which:

if the wireless electronic device is detected during a time greater than a fourth time, the wireless electronic device is deactivated, and if the wireless electronic device is no longer detected, the wireless electronic device is activated.

11. The alarm sensor according to claim 2, wherein the cancellation device performs a method of monitoring wireless electronic devices by wireless electronic device presence analysis, repetitively with a period of analysis, and during each analysis:

if the wireless electronic device is detected, a counter is incremented:

if the counter is over a threshold value, the electronic device is deactivated, which means that it can no longer activate the cancellation device;

if the wireless electronic device is not detected, the counter is reset to an initial value and the wireless electronic device is activated which means that it can activate the cancellation device.

12. The alarm sensor according to claim 11, wherein after the detection of the opening event, the analysis period is adjusted to a first value, then after a predetermined number of analyses, the analysis period is adjusted to a second value longer than the first value.

13. The alarm sensor according to claim 1, wherein the inhibition device is a volumetric sensor which detects a movement of the person and which detects whether said person is going away from said inhibition device, and in which the electronic unit provides the detection signal only if the presence detected by the inhibition device corresponds to the movement of said person away from said inhibition device.

14. The alarm sensor according to claim 1, wherein the inhibition device is a volumetric sensor positioned such that a first plane is a plane substantially perpendicular to the opening and substantially perpendicular to the floor of the area, where said first plane is the plane of highest density of alternating activity and inactivity for a detection of movement.

15. The alarm sensor according to claim 14, wherein the volumetric sensor has a first opening angle less than 45° in said first plane.

16. The alarm sensor according to one of claim 1, wherein the inhibition device is a volumetric sensor which is directed towards an inside handle of the opening or a point located near said handle.

17. The alarm sensor according to claim 1, wherein the inhibition device is a volumetric sensor which comprises two detection elements and a wall located between said detection elements.

18. The alarm sensor according to claim 17, wherein the volumetric sensor does not comprise an optical system for focusing on said detection elements.

19. The alarm sensor according to claim 1, wherein the alarm sensor is suited for being attached onto the opening.

20. An alarm system for a building area comprising;

the alarm sensor according to claim 1; and an alarm central unit suited for receiving the detection signal coming from the alarm sensor and comprises an alert device suited for generating an alert if a detection signal is received.

21. The alarm system according to claim 20, wherein the alarm sensor and the alarm central unit are combined in a single case.

* * * * *